US007285002B2

(12) United States Patent
Liang

(10) Patent No.: US 7,285,002 B2
(45) Date of Patent: Oct. 23, 2007

(54) ELECTRONIC DEVICE ASSEMBLY

(75) Inventor: Jen-Yu Liang, Tu Cheng (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/308,816

(22) Filed: May 11, 2006

(65) Prior Publication Data

US 2007/0099471 A1 May 3, 2007

(30) Foreign Application Priority Data

Oct. 27, 2005 (CN) ..... 2005 1 0100788

(51) Int. Cl.
*H01R 4/50* (2006.01)

(52) U.S. Cl. ..... 439/332

(58) Field of Classification Search ..... 439/332, 439/502, 623–624, 638, 655; 361/784–785; 174/117 F See application file for complete search history.

(56) References Cited

U.S. PATENT DOCUMENTS 3,539,956 A * 11/1970 Andersen et al. ..... 335/154
5,855,064 A * 1/1999 Chang ..... 29/861
6,030,247 A 2/2000 Sasahara
6,283,789 B1 * 9/2001 Tsai ..... 439/502
6,361,372 B1 * 3/2002 Chiang ..... 439/680
7,014,509 B2 * 3/2006 Devine et al. ..... 439/638
7,133,293 B2 * 11/2006 Fiorentino et al. ..... 361/752

* cited by examiner

*Primary Examiner*—J. F. Duverne
(74) *Attorney, Agent, or Firm*—Wei Te Chung

(57) ABSTRACT

An electronic device assembly includes a first electronic device (10), a second electronic device (20), and a connecting device (20) electrically connecting the first electronic device and the second electronic device. The first electronic device includes a first projecting member (14) and a pair of first contact portions (142) disposed on the first projecting member. The connecting device includes a first connecting member (32) electrically connected to the first electronic device, and a second connecting member (34) electrically connected to the second electronic device. The first connecting member includes a pair of second contact portions (326) electrically connecting with the first contact portions respectively. The first projecting member defines a first receiving slot (148), and the first connecting member includes a first protrusion (328) received in the first slot.

18 Claims, 6 Drawing Sheets

ELECTRONIC DEVICE ASSEMBLY

FIELD OF THE INVENTION

The present invention relates to electronic devices, and particularly to an electronic device assembly that connects a first electronic device electrically and firmly to a second electronic device.

DESCRIPTION OF RELATED ART

Electronic devices, such as access points, mobile phones, and so on, are becoming ever more popular. Often, the electronic devices are driven by a direct current power supply, which is fed by an alternating current source. Hence, a transformer is needed to convert the alternating current to the direct current.

Referring to FIG. 6, a conventional electronic device assembly is shown. The electronic device assembly includes an electronic device 10', a transformer 20', and a connecting member 30'. The connecting member 30' includes a plug A' electrically connecting with the electronic device 10', and a plug B' electrically connecting with the transformer 20'. However, there is no latching between the electronic device 10' and the plug A', and between the transformer 20' and the plug B'. Therefore, the plugs A' and B' may accidentally come unplugged and the electronic device 10' may stop functioning.

Therefore, a heretofore unaddressed need exists in the industry to overcome the aforementioned deficiencies and inadequacies.

SUMMARY OF THE INVENTION

In an exemplary embodiment, an electronic device assembly includes a first electronic device, a second electronic device, and a connecting device electrically connecting the first electronic device and the second electronic device. The first electronic device includes a first projecting member and a pair of first contact portions disposed on the first projecting member. The connecting device includes a first connecting member electrically connected to the first electronic device, and a second connecting member electrically connected to the second electronic device. The first connecting member includes a pair of second contact portions electrically connecting with the first contact portions of the first electronic device respectively. The first projecting member defines a first receiving slot, and the first connecting member includes a first protrusion received in the first slot.

Other advantages and novel features will become more apparent from the following detailed description when taken in conjunction with the accompanying drawings, in which:

DETAILED DESCRIPTION OF THE INVENTION

Figure 5:
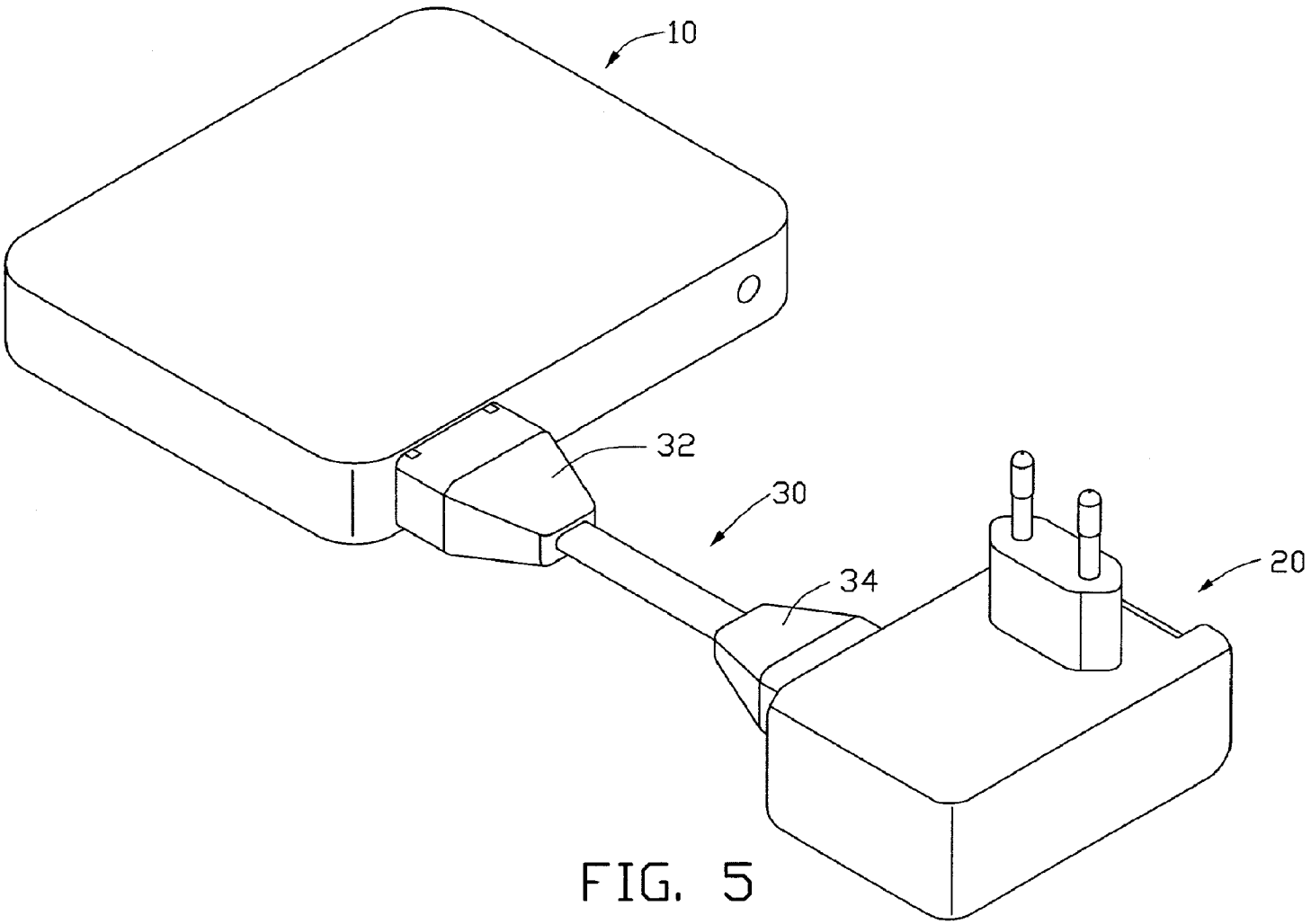
FIG. 5 is an assembled view of the electronic device assembly in accordance with the exemplary embodiment of the present invention.
Figure 6:
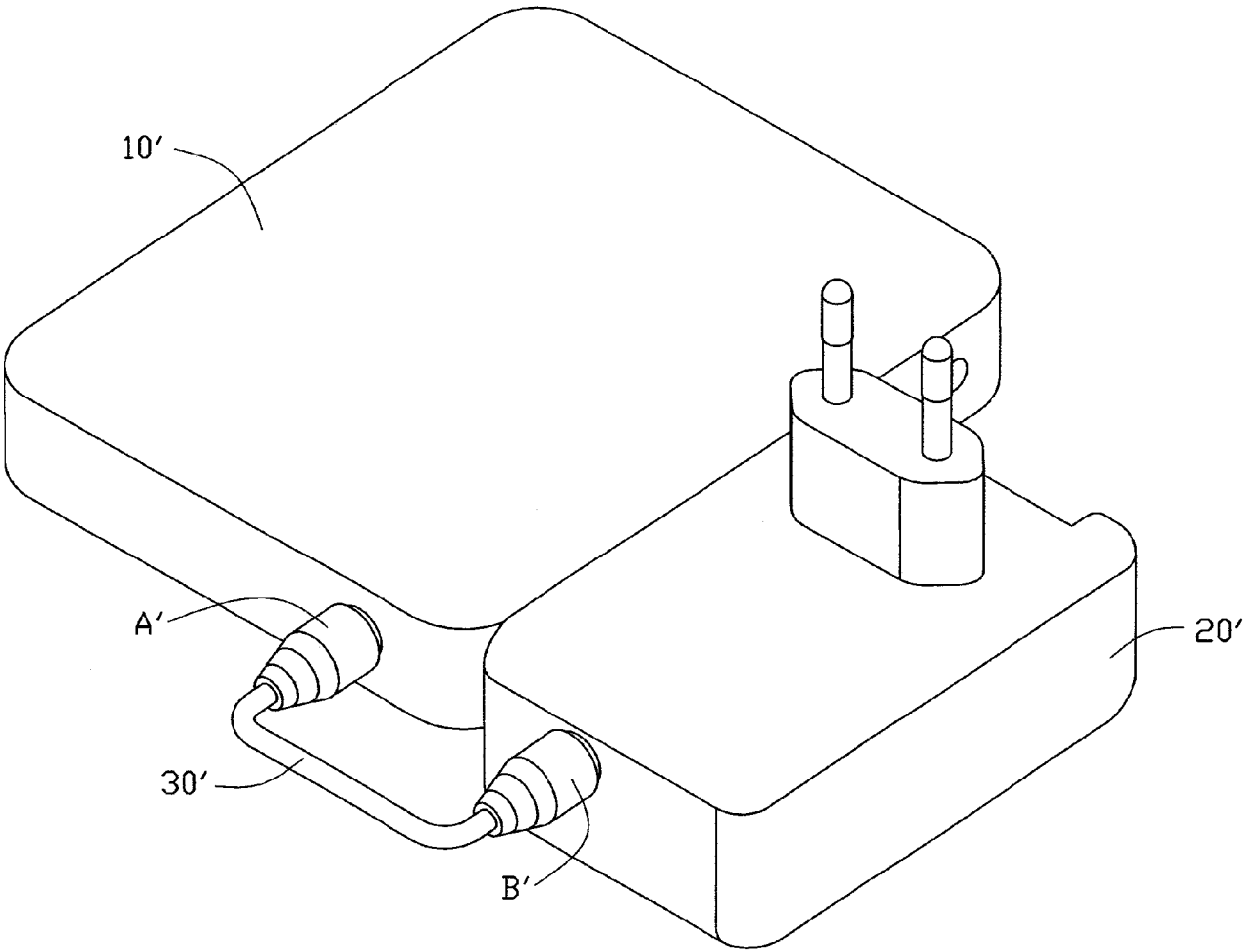
FIG. 6 (RELATED ART)
FIG. 6 is an assembled view of a conventional electronic device assembly.

Referring to FIG. 5, an assembled view of an electronic device assembly in accordance with an exemplary embodiment of the present invention is shown. The electronic device assembly comprises a first electronic device 10, a second electronic device 20, and a connecting device 30.

Figure 1:
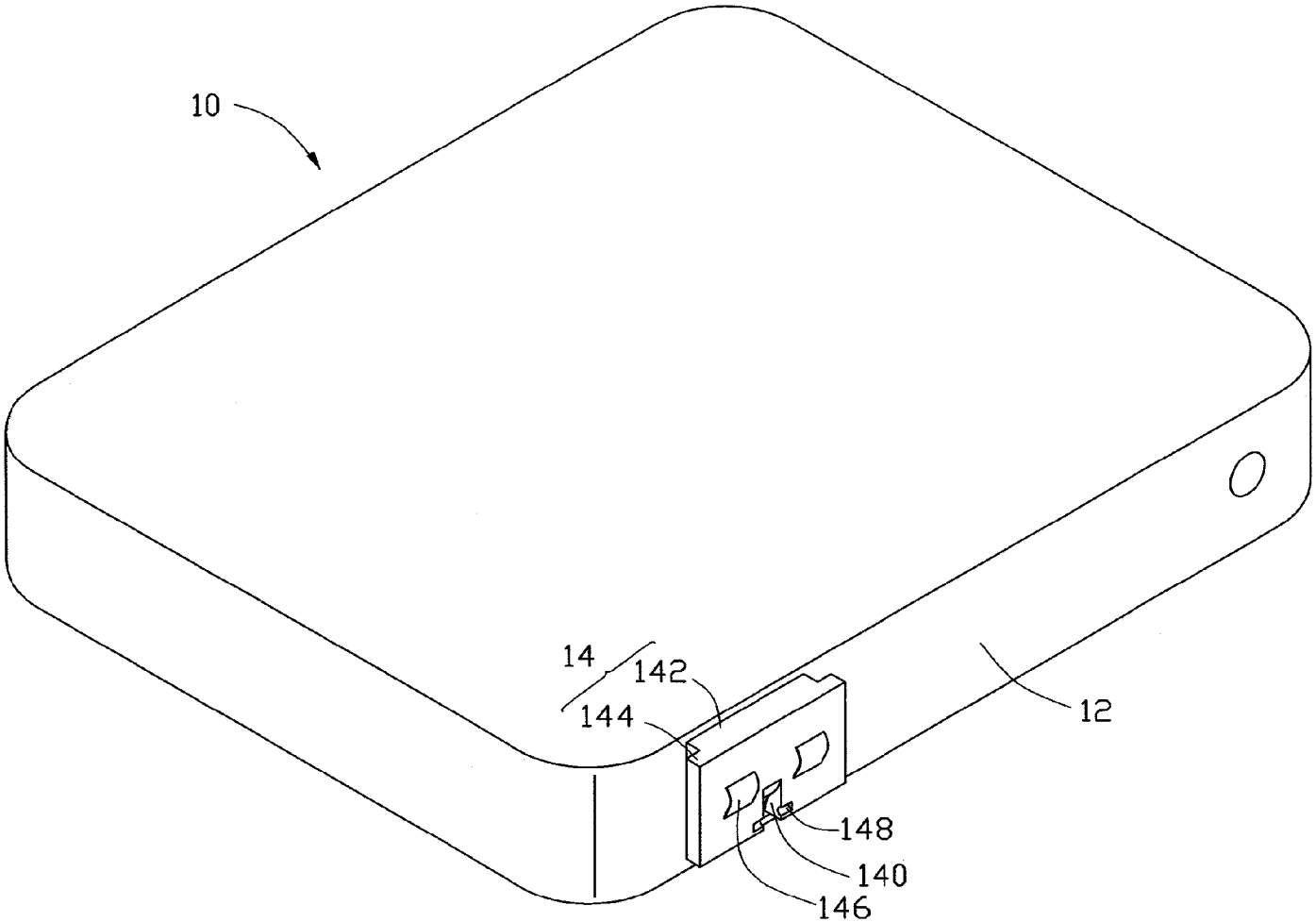
FIG. 1 is an isometric view of a first electronic device of an electronic device assembly in accordance with an exemplary embodiment of the present invention.

FIG. 1 is an isometric view of a first electronic device 10 of the electronic device assembly. The first electronic device 10 may be a communication device, such as an access point (AP), a WiFi repeater, a customer premises equipment (CPE), and so on. The first electronic device 10 comprises a first sidewall 12 and a first T-shaped projecting member 14 protruding from the first sidewall 12. The first projecting member 14 comprises a first connecting portion 142 connecting with the first sidewall 12, and a first fixing portion 144 integrally formed with the first connecting portion 142. A length of the first fixing portion 144 is greater than that of the first connecting portion 142. A pair of spaced first contact portions 146 protrudes from the first fixing portion 144. The first contact portions 146 are aligned along a horizontal first central line of the first fixing portion 144, and electrically connected to inner circuits of the first electronic device 10. A first recessed portion 140 and a first receiving slot 148 are defined in the first fixing portion 144, the first recessed portion 140 in communication with the first receiving slot 148. The first receiving slot 148 is adjacent to a lower edge of the first fixing portion 144. The first recessed portion 140 spans from the first receiving slot 148 to the first central line, and a bottom face of the recessed portion 140 is sloped.

Figure 3:
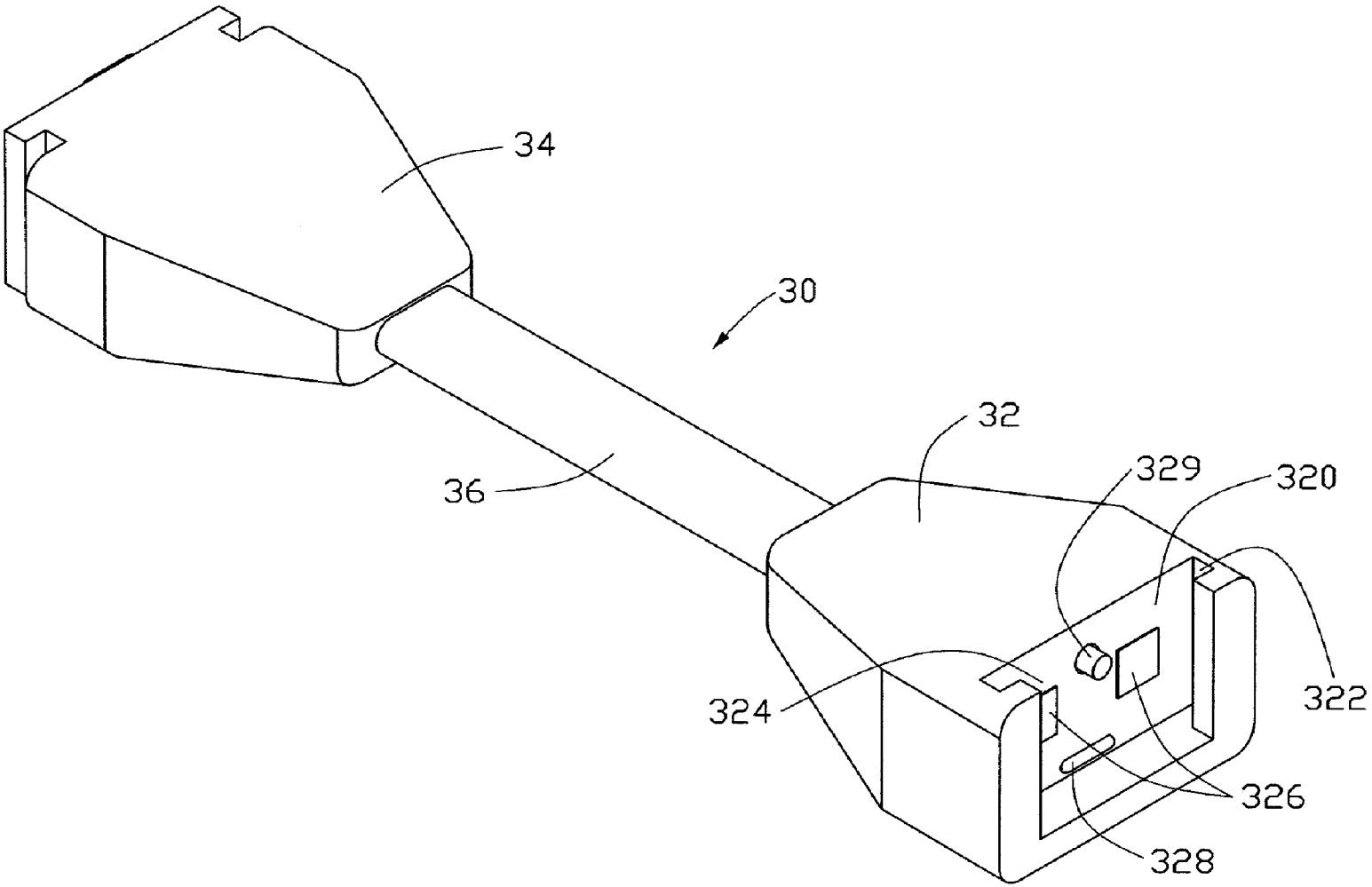
FIG. 3 is an isometric view of a connecting device of the electronic device assembly in accordance with the exemplary embodiment of the present invention.
Figure 4:
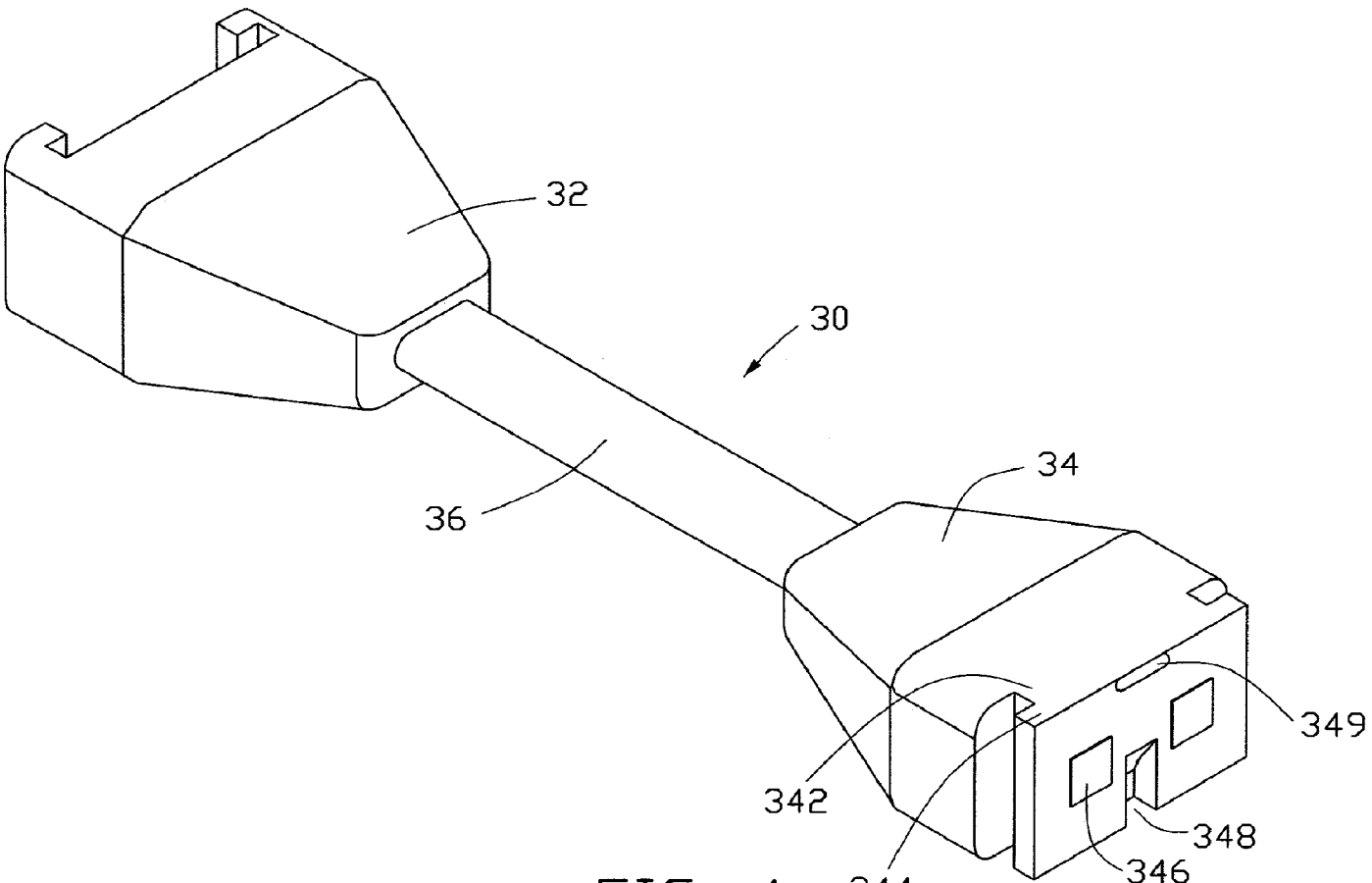
FIG. 4 is similar to FIG. 3, but viewed from another aspect.

Referring to FIGS. 3-4, a connecting device 30 of the electronic device assembly is shown. The connecting device 30 comprises a first connecting member 32, a second connecting member 34, and a cable 36 connecting the first connecting member 32 with the second connecting member 34. The first connecting member 32 defines a first groove 322 adjacent to an Inner surface 320 of a distal end thereof, for receiving the first fixing portion 144 of the first electronic device 10, and a second groove 324 for receiving the connecting member 142 of the first electronic device 10. The second groove 324 is defined in an exterior surface of the distal end adjacent to and communicating with the first groove 322. The first connecting member 32 further comprises a pair of spaced second contact portions 326 for electrically connecting to the first contact portions 146, a first protrusion 328 corresponding to the first receiving slot 148 of the first electronic device 10, and a first safety switch 329. The second contact portions 326, the first protrusion 328, and the first switch 329 protrude from the inner surface 320 of the distal end. The first protrusion 328 and the first receiving slot 148 engage to cooperatively prevent the first projecting member 14 from disengaging from the first connecting member 32 inadvertently.

The second connecting member 34 comprises a second fixing portion 344 formed in a distal end thereof, and a second connecting portion 342 integrally formed with the second connecting portion 34. A length of the second fixing portion 344 is greater than that of the second connecting portion 342. The second connecting member 34 further comprises a pair of spaced fourth contact portions 346 aligned along a horizontal second center line of the second fixing portion 344, a second protrusion 349 projecting from an upper edge of the second fixing portion 344, and a second recessed portion 348 spanning from a lower edge to the second center line. A bottom face of the second recessed portion 348 is sloped.

Figure 2:
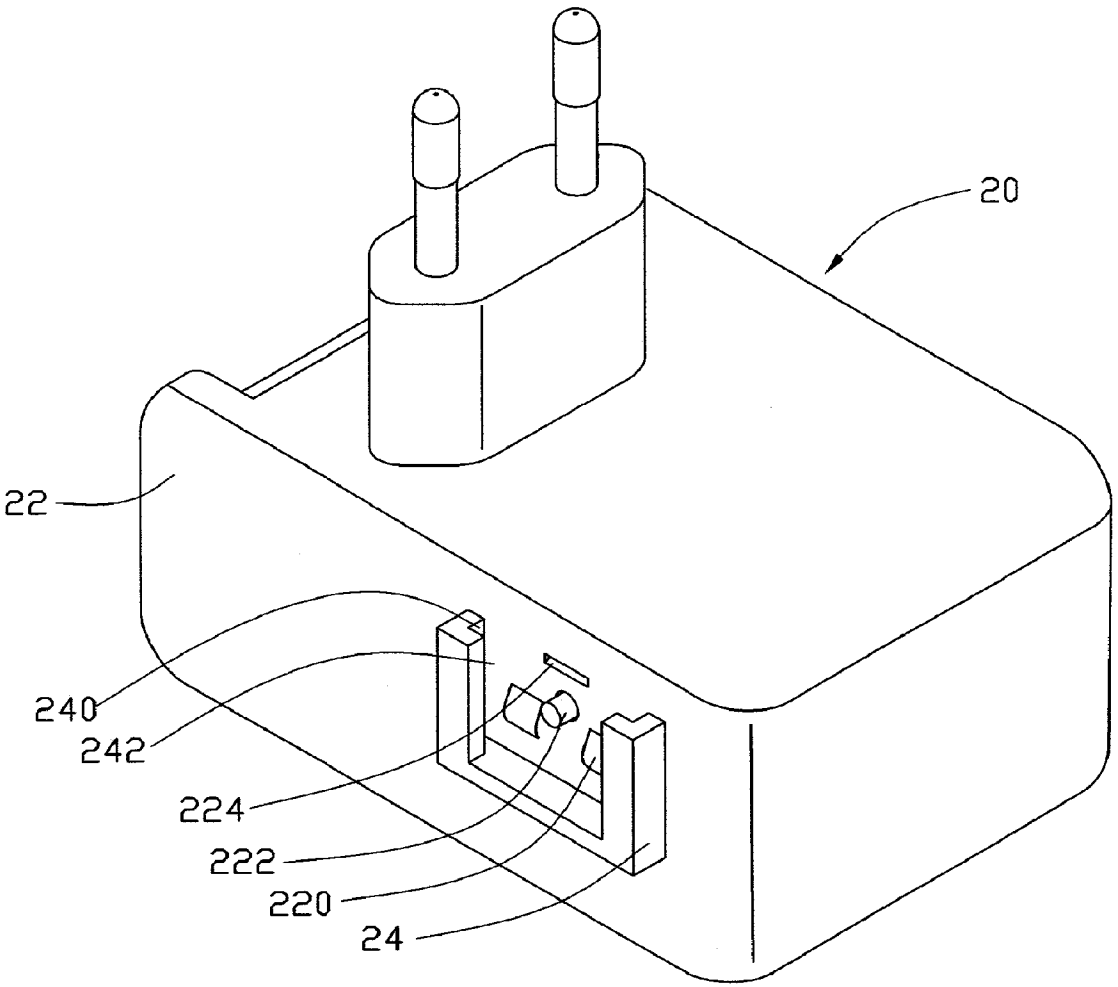
FIG. 2 is an isometric view of a second electronic device of the electronic device assembly in accordance with the exemplary embodiment of the present invention.

FIG. 2 is an isometric view of a second electronic device 20 of the electronic device assembly. The second electronic device 20 may be a transformer or a communication device. The second electronic device 20 comprises a second sidewall 22 and a second projecting member 24 protruding from the second sidewall 22. The second projecting member 24 defines a third groove 240 adjacent to the second sidewall 22, and a fourth groove 242 defined in an exterior surface thereof, in communication with and adjacent to the third groove 240. The second electronic device 20 further comprises a pair of third contact portions 220 for electrically connecting with the fourth contact portions 346 of the second connecting member 34, a second safety switch 222, and a second receiving slot 224 defined in the second sidewall 22 for receiving the second protrusion 349 of the second connecting member 34. The second protrusion 349 and the second receiving slot 224 engage to cooperatively prevent the second connecting member 34 from disengaging from the second receptacle 24 inadvertently.

Referring to FIGS. 1-5, in assembly, the first projecting member 14 of the first electronic device 10 is connected to the first connecting member 32 of the connecting device 30, and the second projecting member 24 of the second electronic device 20 is connected to the second connecting member 34 of the connecting device 30. Thus, the first electronic device 10 is connected to the second electronic device 20. In this position, the first connecting portion 142 of the first electronic device 10 is received in the second groove 324 of the first connecting member 32. The first fixing portion 144 of the first electronic device 10 is received In the flrst groove 322 of the first connecting member 32. The first protrusion 328 of the first connecting member 32 is received in the first receiving slot 148 of the first electronic device 10. The first contact portions 146 electrically connect with the second contact portions 326. The first switch 329 is slidably received by the first recessed portion 140, and during this action the first switch 329 is gnrdually depressed by the sloped bottom face of the first recessed portion 140 until the first switch 329 is completely depressed to control the electrical connection of the second contact portions 326 and inner circuits of the first connecting member 32. Thus, the first electronic device 10 is electrically connected to the second connecting member 32. The second connecting member 342 is received in the fourth groove 242, and the second fixing member 344 is received in the third groove 240. The second protrusion 349 is received in the second receiving slot 224. The third contact portions 220 electrically connect with the fourth contact portions 346. The second switch 222 is slidably received by the second recessed portion 348, and during this action the second switch 222 is gradually depressed by the doped bottom face or the second recessed portion 348 until the second switch 222 is completely depressed to control the electrical connection of the third contact portions 220 and inner circuits of the second connecting member 34. Thus, the second electrical device 20 is electrically connected to the second connecting member 34. That is, when the first switch 329 and the second switch 222 are both completely depressed, the first electrical device 10 is electrically connected to the second electronic device 20.

Because the first electronic device 10 is connected to the second electronic device 20 via the connecting device 30, and a length of the cable 36 of the connecting device 30 is not limited, the electrical connection of the first electronic device 10 and the second electronic device 20 is insured when the first electronic device 10 is away from the second electronic device 20. For example, when the first electronic device 10 is installed in a ceiling having no power receptacle, the second electronic device 20 can be mounted elsewhere, by using the connecting device 30 with a long cable 36. In addition, by being able to have a distance between the first electronic device 10 and the second electronic device 20, heat generated by the devices 10, 20 can not combine to negatively effect performance of either of the devices 10, 20.

Because the first protrusion 328 is received in the first receiving slot 148, the first electronic device 10 cannot be accidentally detached from the connecting device 30. Meanwhile, because the second protrusion 349 is received in the second receiving slot 224, the second electronic device 20 also cannot be accidentally detached from the connecting device 30. Thus, the electrical connection of the first electronic device 10 and the second electronic device 20 is ensured.

Because the first electronic device 10 is electrically connected to the second electronic device 20 only if the first safety switch 329 and the second safety switch 222 are completely depressed, an accidental electric shock of a user is voided.

While the exemplary embodiment has been described above, it should be understood that it has been presented by way of example only and not by way of limitation. Thus the breadth and scope of the present invention should not be limited by the above-described exemplary embodiments, but should be defined only in accordance with the following claims and their equivalents.

What is claimed is:

1. An electronic device assembly comprising:

a first electronic device comprising a first sidewall, a first projecting member protruding from the first sidewall, and a pair of first contact portions arranged on the first projecting member, the first projecting member comprising a first connecting portion, a first fixing portion integrally formed with the first connecting portion, and a first receiving slot, the first contact portions aligned along a horizontal central line of the first fixing portion;

a second electronic device; and a connecting device electrically connecting the first electronic device and the second electronic device, the connecting device comprising a first connecting member electrically connected to the first electronic device, and a second connecting member electrically connected to the second electronic device, the first connecting member comprising a pair of second contact portions electrically connecting with the first contact portions of the first electronic device respectively, and a first protrusion received in the first receiving slot of the first electronic device;

wherein a first recessed portion is defined in the first fixing portion, and the first connecting member comprises a first switch slidably received in the first recessed portion.

2. The electronic device assembly as claimed in claim 1, wherein the first receiving slot is adjacent to an edge of the first fixing portion.

3. The electronic device assembly as claimed in claim 1, wherein a length of the first fixing portion is greater than that of the first connecting portion.

4. The electronic device assembly as claimed in claim 1, wherein the first switch has a safety function, and the second contact portions are electrically connected to inner circuits of the first connecting member when the first switch is completely depressed.

5. The electronic device assembly as claimed in claim 1, wherein a bottom face of the first recessed portion is sloped.

6. The electronic device assembly as claimed in claim 1, wherein the first connecting member defines a first groove, and a second groove in communication with the first groove and an exterior.

7. The electronic device assembly as claimed in claim 6, wherein the first connecting portion is received in the second groove, and the first fixing portion is received in the first groove.

8. The electronic device assembly as claimed in claim 1, wherein the second electronic device comprises a second sidewall, a second r projecting member protruding from the second sidewall, and a pair of third contact portions arranged on the second sidewall.

9. The electronic device assembly as claimed in claim 8, wherein the second connecting member comprises a pair of fourth contact portions electrically connected to the third contact portions respectively.

10. The electronic device assembly as claimed in claim 8, wherein the second projecting member defines a third groove, and a fourth groove in communication with the third groove and an exterior.

11. The electronic device assembly as claimed in claim 10, wherein the second connecting member comprises a second connecting portion received in the fourth groove, and a second fixing portion integrally formed with the second connecting portion and received in the third groove.

12. The electronic device assembly as claimed in claim 8, wherein a second receiving slot is defined in the second sidewall of the second electronic device, and the second connecting member comprises a second protrusion received in the second receiving slot.

13. The electronic device assembly as claimed in claim 8, wherein the second electronic device further comprises a second switch, and the second connecting member defines a second recessed portion for slidably receiving the second switch.

14. The electronic device assembly as claimed in claim 13, wherein a bottom face of the second recessed portion is sloped.

15. The electronic device assembly as claimed in claim 13, wherein the second switch has a safety function, and the third contact portions are electrically connected to inner circuits of the second connecting member when the second switch is completely depressed.

16. An electronic device assembly comprising:

a first electronic device comprising a first projecting member and a pair of first contact portions arranged on the first projecting member;

a second electronic device comprising a second sidewall, a second projecting member protruding from the second sidewall, a pair of contact portions arranged on the second sidewall, and a switch; and a connecting device electrically connecting the first electronic device and the second electronic device, the connecting device comprising a first connecting member electrically connected to the first electronic device, and a second connecting member electrically connected to the second electronic device, the first connecting member comprising a pair of second contact portions electrically connecting with the first contact portions of the first electronic device respectively, the second connecting member defining a recessed portion configured and arranged for slidably receiving the switch;

wherein the switch has a safety function, and the contact portions are electrically connected to inner circuits of the second connecting member when the switch is completely depressed.

17. An electronic device assembly comprising:

a first electronic device comprising a first sidewall, a first projecting member protruding from the first sidewall, and a pair of first contact portions arranged on the first projecting member, the first projecting member comprising a first connecting portion extending out of the first sidewall, and a first fixing portion integrally formed with the first connecting portion and spaced from the first sidewall, a length of the first fixing portion being greater than a length of the flrst connecting portion;

a second electronic device; and a connecting device electrically connectable between the first electronic device and the second electronic device, the connecting device comprising a first connecting member electrically connectable with the first electronic device, and a second connecting member electrically connectable with the second electronic device, the first connecting member comprising a pair of second contact portions electrically connectable with the first contact portions of the first electronic device respectively when the first connecting member moves toward a final position thereof relative to the first electronic device so as to abut against the first sidewall of the first electronic device, the first connecting member movably engageable with the first projecting member of the first electronic device along a direction exclusively parallel to the first sidewall of the first electronic device due to the length of the first fixing portion so as to move toward the final position of the first connecting member.

18. The electronic device assembly as claimed in claim 17, wherein a first recessed portion is defined in the first fixing portion, and the first connecting member comprises a first switch slidably received in the first recessed portion.

* * * * *